US009919839B2

(12) United States Patent
Mirbach

(10) Patent No.: US 9,919,839 B2
(45) Date of Patent: Mar. 20, 2018

(54) COLLAPSIBLE BOTTLE WITH FLOW CHANNELS

(71) Applicant: OP-Hygiene IP GmbH, Niederbipp (CH)

(72) Inventor: Ali Mirbach, Issum (DE)

(73) Assignee: OP-Hygiene IP GmbH, Niederbipp (CH)

( * ) Notice: Subject to any disclaimer, the term of this patent is extended or adjusted under 35 U.S.C. 154(b) by 92 days.

(21) Appl. No.: 14/855,012

(22) Filed: Sep. 15, 2015

(65) Prior Publication Data

US 2016/0075476 A1 Mar. 17, 2016

(30) Foreign Application Priority Data

Sep. 15, 2014 (CA) ..... 2863342

(51) Int. Cl.

| | |
|---|---|
| ***B65D 21/08*** | (2006.01) |
| ***B65D 83/00*** | (2006.01) |
| ***B65D 1/40*** | (2006.01) |
| ***B65D 1/32*** | (2006.01) |
| ***B65D 1/02*** | (2006.01) |

(52) U.S. Cl.

CPC ..... *B65D 21/086* (2013.01); *B65D 1/0223* (2013.01); *B65D 1/0292* (2013.01); *B65D 1/32* (2013.01); *B65D 1/40* (2013.01); *B65D 83/0055* (2013.01); *B65D 2231/008* (2013.01); *B65D 2501/0027* (2013.01); *B65D 2501/0081* (2013.01)

(58) Field of Classification Search

CPC .. B65D 21/068; B65D 1/0292; B65D 1/0223; B65D 1/32; B65D 1/40; B65D 2501/0027; B65D 2501/0081; B65D 83/0055

USPC ..... 220/666, 671; 215/900, 382; 222/92, 95

See application file for complete search history.

(56) References Cited

U.S. PATENT DOCUMENTS

| | | | | |
|---|---|---|---|---|
| 2,685,316 | A | 5/1952 | Krasno | |
| 3,580,427 | A * | 5/1971 | Clarke | B65D 47/2031 222/215 |
| 3,727,803 | A * | 4/1973 | Cobb | B65D 35/08 222/215 |
| 3,926,341 | A * | 12/1975 | Lhoest | A61J 1/05 215/383 |
| 5,080,260 | A * | 1/1992 | During | B29C 49/48 222/107 |
| 5,174,458 | A * | 12/1992 | Segati | B65D 1/0292 215/383 |
| 6,223,932 | B1 * | 5/2001 | Usui | B65D 1/0292 215/382 |
| 7,530,475 | B2 | 5/2009 | Ophardt | |
| 8,365,954 | B2 | 2/2013 | Ophardt et al. | |
| 8,672,183 | B2 | 3/2014 | Ophardt et al. | |

(Continued)

FOREIGN PATENT DOCUMENTS

| | | |
|---|---|---|
| WO | 2014029575 | 2/2014 |

*Primary Examiner* — Jeffrey Allen
*Assistant Examiner* — Jennifer Castriotta
(74) *Attorney, Agent, or Firm* — Thorpe North & Western LLP

(57) ABSTRACT

A collapsible bottle with a channelway provided in a side wall which, in collapsed conditions of the bottle, the channelway becomes engaged with opposed portions of the side wall and define a flow passageway therethrough toward a discharge opening at one end of the bottle and a closed other end of the bottle.

20 Claims, 11 Drawing Sheets

(56) References Cited

U.S. PATENT DOCUMENTS

| | | | | |
|---|---|---|---|---|
| 2008/0302830 | A1* | 12/2008 | Loth-Krausser ..... | A61F 9/0008<br>222/215 |
| 2014/0217117 | A1 | 8/2014 | Mirbach | |
| 2015/0239599 | A1 | 8/2015 | Leroux et al. | |

* cited by examiner

COLLAPSIBLE BOTTLE WITH FLOW CHANNELS

SCOPE OF THE INVENTION

This invention relates to collapsible containers for fluids and, more particularly, to a collapsible bottle having flow channels in a side wall of the bottle.

BACKGROUND OF THE INVENTION

Collapsible bottles are well known as to contain fluid material with the fluid to be dispensed from an opening of the container with collapsing of the container. For example, hand cleaning fluid dispensers are known incorporating a pump for drawing fluid from a collapsible container and dispensing it onto a user's hand.

A disadvantage of previously known collapsible containers is that the containers sometimes collapse in a manner which traps fluid in the container. For example, the collapsible container may collapse prematurely at a middle portion along the length of the container preventing fluid in the container from flowing through the collapsed intermediate portion to a discharge opening. This disadvantage is particularly acute when the fluid to be dispensed is expensive and under circumstances when the dispensing of fluid is critical to be maintained. This disadvantage generally increases with increases in the viscosity of the material to be dispensed and particularly with fluids including particulate matter such as pumice in a hand cleaning fluid.

SUMMARY OF THE INVENTION

To at least partially overcome these disadvantages of previously known devices, the present invention provides a collapsible bottle with a channelway provided in a side wall which, in collapsed conditions of the bottle, the channelway becomes engaged with opposed portions of the side wall and defines a flow passageway therethrough toward a discharge opening at one end of the bottle and a closed other end of the bottle.

The present invention also provides a collapsible bottle including an encircling side wall with a front wall portion and a rear wall portion opposed to the front wall portion in which front and rear wall portions of the side wall are drawn towards each other and into engagement as the bottle is collapsed, and wherein a channelway is provided in the front wall portion defining a flow channel open towards the rear wall portion and, in a collapsed bottle, the rear wall portion engages the front wall portion to bridge the flow channel and define a flow passage therein extending within the bottle toward a discharge opening of the bottle.

In one aspect, the present invention provides a collapsible bottle having a first end and a second end;

the bottle having an enclosed cavity defined between the first end and the second end and an encircling side wall bridging between the first end and the second end, the side wall including a front wall and a rear wall opposed to the front wall, a discharge opening at the first end, wherein the bottle is collapsible such that when vacuum conditions are applied to the opening, the bottle collapses with the front wall and the rear wall drawn towards each other and into engagement with each other, a channelway provided in the front wall, the channelway defining a flow channel which is open toward the rear wall between the first end and the second end, wherein during collapse of the bottle when the front wall and the rear wall are drawn into engagement, the rear wall engages the front wall to bridge the flow channel and a flow passageway is defined between the channelway of the front wall and the rear wall permitting fluid flow therethrough between the first end and the second end.

BRIEF DESCRIPTION OF THE DRAWINGS

Further aspects and advantages of the present invention will become apparent from the following description taken together with the accompanying drawings in which:

FIG. 8 is a left side view of the bottle of FIG. 6;

DETAILED DESCRIPTION OF THE DRAWINGS

Figure 1:
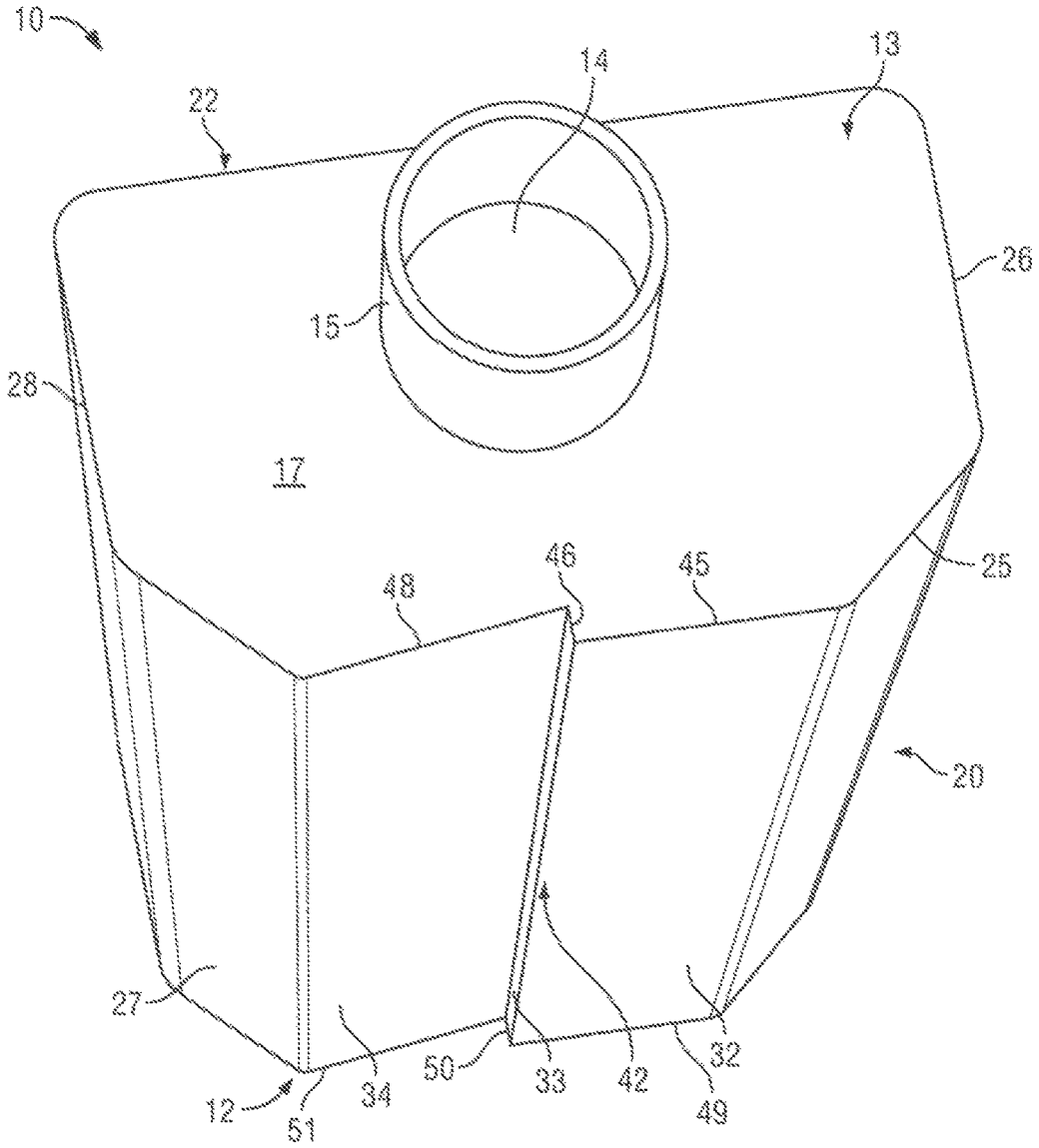
FIG. 1 is a pictorial view of a collapsible bottle in accordance with a first embodiment of the present invention.
Figure 3:
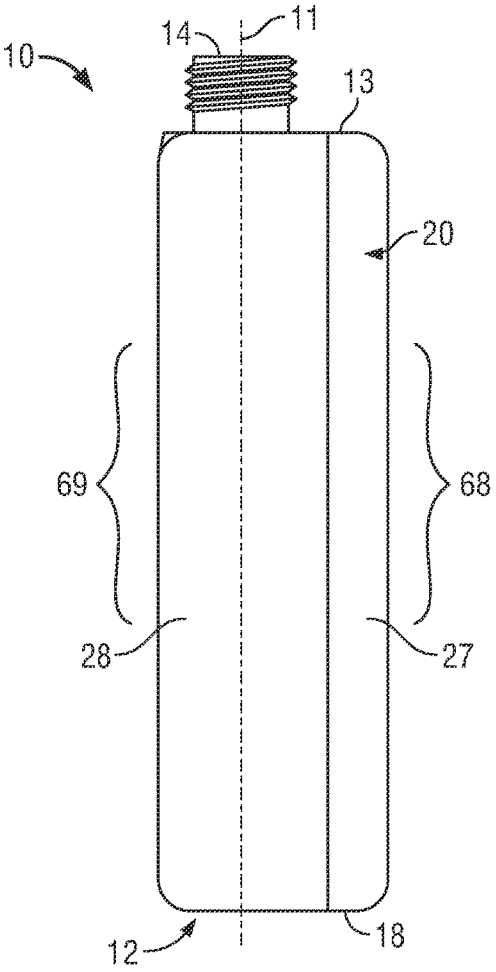
FIG. 3 is a left side view of the bottle of FIG. 1.
Figure 2:
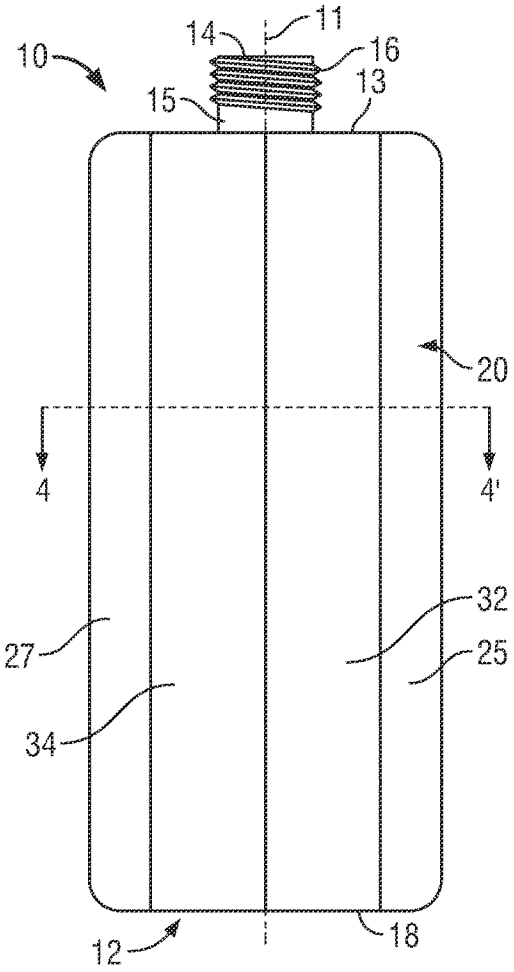
FIG. 2 is a front view of the bottle of FIG. 1.

Reference is made to FIGS. 1 to 5 which illustrate a first embodiment of a collapsible bottle 10 in accordance with the present invention. The bottle 10 is illustrated to extend along a central axis 11 from a closed end 12 to an open end 13.

The container has an opening or discharge outlet 14 at the open end 13. The bottle 10 has a cylindrical neck 15 about the outlet 14 carrying external threads 16. The open end 13 has a top wall 17. The closed end 12 has a bottom wall 18. A side wall 20 bridges between the closed end 12 and the open end 13, that is, between the top wall 17 and the bottom wall 18 with the side wall 20 encircling the bottle 10.

The side wall 20 includes a front wall 21, a rear wall 22 opposed to the front wall 21, a right wall 23 and a left wall 24. Each of the right wall 23 and the left wall 24 bridge between the front wall 21 and the rear wall 22 on the right and left sides thereof, respectively. The right wall 23 comprises a front right portion 25 and a rear right portion 26. The left wall 24 comprises a front left portion 27 and a rear left portion 28.

An enclosed cavity 30 is defined between the bottom wall 18 of the closed end 12 and the top wall 17 of the open end 13 inside the side wall 20 open via the outlet 14 at the open end 13.

The front wall 21 comprises three portions, namely, a right face portion 32, an intermediate step portion 33 and a left face portion 34. The rear wall 22 is disposed substantially in a flat plane parallel the axis 11. The right face portion 32 is disposed in a plane parallel to the rear wall 22 and extends from the right wall 23 to the step portion 33. The step portion 33 is disposed in a plane perpendicular to the rear wall 22 and the right face portion 32 with the step portion 33 extending rearwardly towards the rear wall 22 from the right face portion 32 to the left face portion 34. The left face portion 34 extends from an inner edge of the step portion 33 to the left wall 24. Each of the rear wall 22, the front right portion 25, the rear right portion 26, the front left portion 27, the rear left portion 28, the right face portion 32, the step portion 33 and the left face portion 34 are rectangular panels disposed side by side and extending parallel to the central axis 11. The right face portion 32 merges with the front right portion 25 at a right corner 36 and the left face portion 34 merges with the front left portion 27 at a left corner 37. The right corner 36 and the left corner 37 are located from the rear wall 22 the same perpendicular distance and thus are disposed in the same flat plane as the right face portion 32. The left face portion 34 extends from the left corner 37 towards the rear wall 22 as it extends toward the inner edge of the step portion 33.

A front step corner 40 is defined between the right face portion 32 and the step portion 33. A rear step corner 41 is provided between the left face portion 34 and the step portion 33. The side wall 20 has an interior surface 38 and an exterior surface 39. About the front step corner 40, the interior surface 38 over the right face portion 32 forms an angle A with the interior surface 38 over the step portion 33. About the rear step corner 41, the exterior surface 39 over the left face portion 34 forms an angle B with the exterior surface 39 over the step portion 33. The angle A is shown as being 90 degrees in the first embodiment. The angle B is shown as 83 degrees in the first embodiment.

Figure 4:
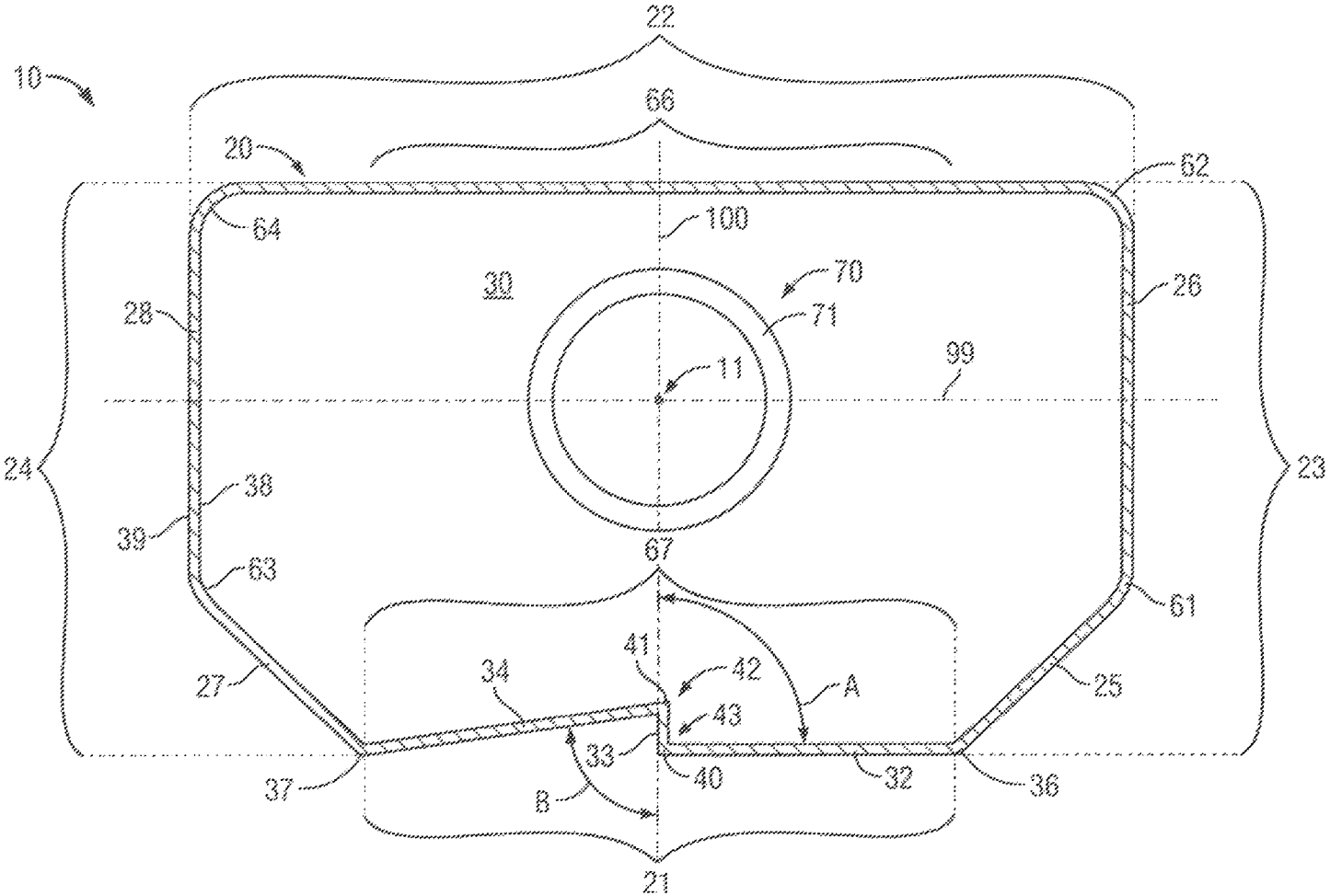
FIG. 4 is a cross-sectional view of the bottle of FIG. 1 along section line 4-4' in FIG. 2.

FIG. 4 illustrates a top cross-sectional view of the bottle 10 of FIG. 1 in an uncollapsed condition. In contrast, FIG. 5 is a top cross-sectional view the same as in FIG. 4, however, showing the bottle 10 in a fully collapsed condition.

Figure 5:
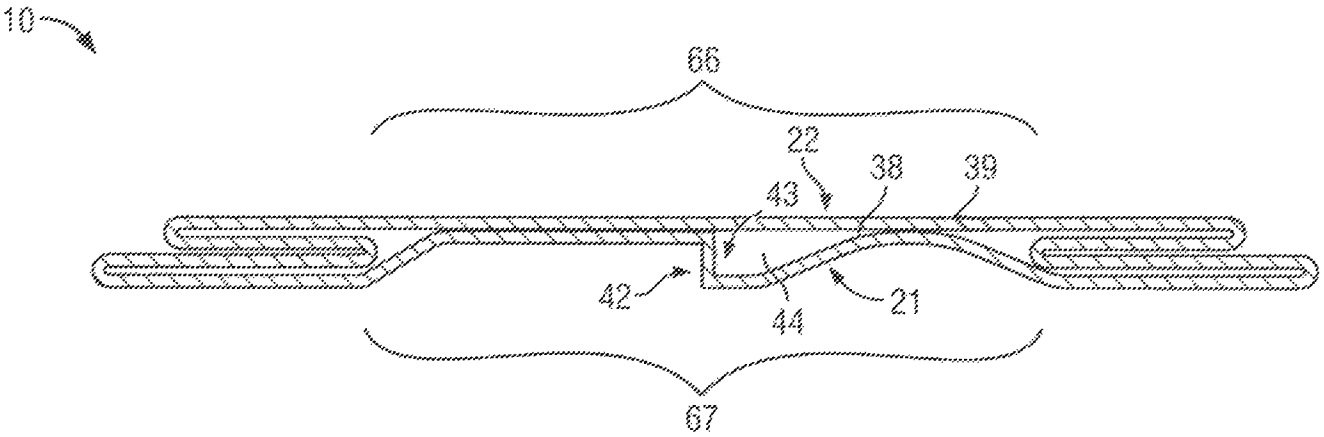
FIG. 5 is a cross-sectional view similar to FIG. 4 but showing the bottle in a fully collapsed condition.

In collapse of the bottle 10, the front wall 21 and the rear wall 22 are drawn towards each other until in the fully collapsed condition of FIG. 5, the interior surface 38 over the front wall 21 comes into engagement with the interior surface 38 over the rear wall 22. A channelway 42 is defined by the right face portion 32 and the step portion 33 with the channelway 42 defining a flow channel 43 which is open into the interior of the bottle 10 towards the rear wall 22. The channelway 42 and its flow channel 43 extend longitudinally of the front wall 21 between the closed end 12 and the open end 13. During collapse of the bottle 10 when the front wall 21 is drawn into engagement with the rear wall 22, the rear wall 22 engages the front wall 21 to bridge the flow channel 43 and, as seen in FIG. 5, a flow passageway 44 is defined including the flow channel 43 between the channelway 42 of the front wall 21 and the rear wall 22.

Referring to FIG. 4, the channelway 42 is defined between the inwardly directed interior surface 38 over the right face portion 32 which opens into the cavity 30 and the inwardly directed interior surface 38 over the step portion 33 which opens into the cavity 30 opposed to the interior surface 38 over the right face portion 32. As can be seen in FIG. 1, the channelway 42 is closed at the closed end 12 by the bottom wall 18 and the channelway 42 is closed at the open end 13 by the top wall 17.

The right face portion 32 merges with the top wall 17 at a top corner 45, the step portion 33 merges with the top wall 17 at a top corner 46 and the left face portion 34 merges with the top wall at a top corner 48. Similarly, the right face portion 32 merges with the bottom wall 18 at a bottom corner 49, the step portion 33 merges with the bottom wall 18 at a bottom corner 50 and the left face portion 34 merges with the bottom wall 18 at a bottom corner 51. The front step corner 40 and the rear step corner 41 assist in providing structure to the front wall 21 resistant to collapse of the channelway 42 under conditions which may exist within the bottle 10 when it is being collapsed or collapsed. The corners 45, 46, 47, 48, 49, 50 and 51 further assist in providing structure and rigidity to the channelway 42 under conditions which may exist within the bottle 10 when it is collapsed.

The bottle 10 is to contain a fluid which is to be drawn from the opening 14 as when vacuum conditions are applied to the opening 14 as, for example, by a pump, not shown. The vacuum conditions applied to the opening 14 include a threshold vacuum condition required to draw a substantial portion of the fluid from the opening as, for example, to substantially draw all of the fluid from the bottle 10 so as to achieve the collapsed condition as illustrated in FIG. 5. The threshold vacuum which is required to be applied to the opening 14 to fully collapse the bottle to the condition of FIG. 5 will vary depending upon the nature of the fluid within the bottle. For example, the threshold vacuum condition will increase in pressure below atmosphere with an increase in viscosity of the fluid. The viscosity of the fluid will typically decrease with temperature of the fluid. Having regard to the nature of the fluid which the bottle is to contain and ambient conditions such as temperature under which fluid is to be drawn from the bottle, the relative strength of the side wall 20 forming the bottle 10 and, particularly the channelway 42, is to be selected to maintain the channelway 42 against collapse so as to maintain the flow channel 43 and flow passageway 44 to provide for fluid flow longitudinally of the bottle 10 through the flow channel 43 provided the vacuum conditions within the bottle 10 do not exceed the threshold vacuum conditions needed to draw fluid from the bottle and fully collapse the bottle 10.

The bottle is preferably formed by a manufacturing process including a blow molding step in which a parison or pre-mold is clamped in a mold and compressed gas blown into the parison or pre-mold to push the plastic outwardly into the mold.

The bottle 10 of FIGS. 1 to 5 has a configuration which assists in a controlled collapse of the bottle to the collapsed condition as seen in FIG. 5. As seen in FIG. 4, the bottle 10 is symmetrical about a flat central plane 100 including the axis 11, and another flat plane 99 is shown including the axis 11 normal to the central plane. The rear wall 22 is shown as parallel to the plane 99. Referring to FIG. 4, the bottle has a shape as seen in top view with the right wall 23 and the left wall 24 being spaced a greater distance than the rear wall 22 and the front wall 21 are spaced. The bottle 10 has the central axis 11 centered between the right wall 23 and the left wall 24 but displaced towards the rear wall 22, that is, closer to the rear wall 22 than to the front wall 21, as seen by the plane 99 being closer to the rear wall 22 than the front wall 21.

The front right portion or panel 25 is joined to the rear right panel 26 over a mid-corner 61. The rear right portion or panel 26 is joined to the rear wall 22 over a rear corner 62. The front left portion or panel 27 is joined to the rear left panel 28 over a mid-corner 63. The rear left portion or panel 28 is joined to the rear wall 22 over a rear corner 64.

The bottle 10 is preferably blow molded from a preferred parison 70 schematically shown in FIG. 4 as having a cylindrical parison wall 71 disposed about the central axis 11 and of constant thickness radially. As the cylindrical parison wall 71 of the parison 70 is expanded outwardly in blow molding to form the side wall 20, the portions of the side wall 20 which are farthest from the central axis 100 have the thickness of the parison wall 71 reduced the greatest. The side wall 20 over the right wall 23 and the left wall 24 have a wall thickness less than the wall thickness of the rear wall 22 and the front wall 21. Over the right wall 23 and the left wall 24, the rear corners 62 and 64 and the mid-corners 61 and 63 have the least thickness. The rear wall 22 has a greatest thickness proximate the central plane and greater over a central portion indicated 66 than over portions closer to the right wall 23 or the left wall 24. Similarly, the front wall 21 has greatest thickness proximate the central plane and generally greater over a central portion indicated 67 than over portions closer to the right wall 23 or the left wall 24. The greater thickness of the front wall 21 over the central portion 67 renders it advantageous to have the channelway 42 provided close to the central plane towards having the panels forming the channelway 42 of relatively increased thickness so as to resist collapse of the channelway 42 when vacuum is applied to the bottle, preferably to have the channelway 42 more resistant to bending and collapse than the right wall 23 and the left wall 24 and the rear corners 62 and 64 and the mid-corners 61 and 63.

This configuration of the bottle 10 is advantageous so that the bottle will collapse as indicated in FIG. 5 with the right wall 23 and the left wall 24 folding inwardly upon themselves and the front wall 21 and the rear wall 22 being drawn towards each other and into engagement over their middle portions 66 and 67 between the collapsed right wall 23 and the collapsed left wall 24 as seen in FIG. 5. The front wall 21 has, as shown on FIG. 3, an intermediate portion 68 of the front wall 21 approximately mid-way between the top wall 17 and the rear wall 22, and the rear wall 22 similarly has, as also shown on FIG. 3, an intermediate portion 69 of the rear wall 22 approximately mid-way between the top wall 17 and the bottom wall 18. During collapse of the bottle 10 from a full condition to the fully collapsed condition, intermediate portion 68 of the front wall 21 and the intermediate portion 69 of the rear wall 22 are often drawn inwardly towards each other and into engagement with each other over their middle portions 66 and 67 before other portions of the front wall 21 and the rear wall 22 closer to the open end 13 or the closed end 12 are drawn together. This engagement over the intermediate portions 68 and 69 in a bottle without the channelway 42 often prevents fluid flow longitudinally in the bottle and can trap fluid in the bottle in the cavity at the closed end against being withdrawn from the outlet of the bottle. Providing the channelway 42 at least longitudinally across the intermediate portions 68 and 69, provides for longitudinal flow of the fluid between the engaged middle portions 66 and 67 of the front wall 21 and the rear wall 22 at all times during collapse of the bottle.

Reference is made to FIGS. 6 to 10 which illustrate a second embodiment of a collapsible bottle 10 in accordance with the present invention. The bottle 10 of the second embodiment has many similarities to the bottle of the first embodiment and similar reference numerals are used to refer to similar elements.

Figure 6:
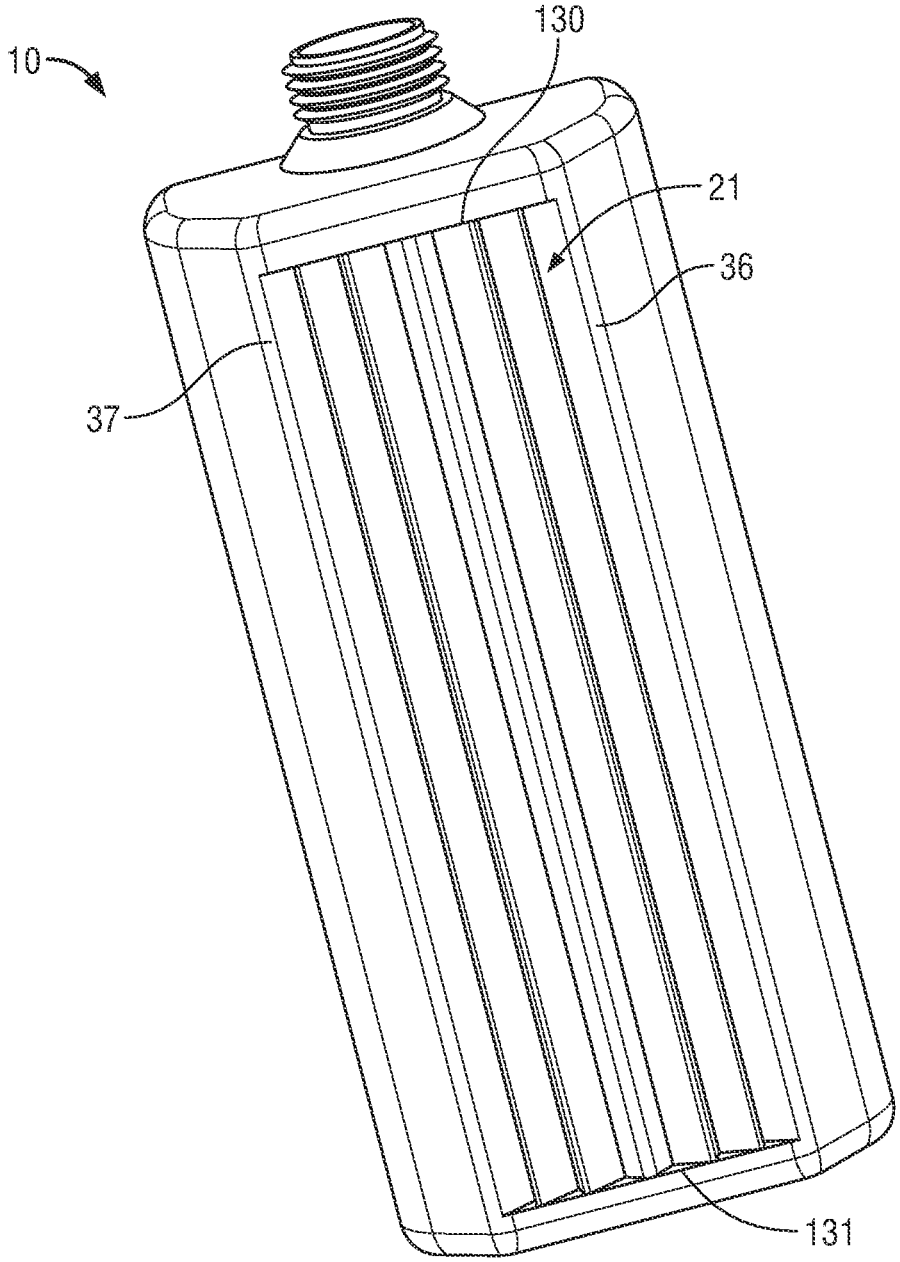
FIG. 6 is a pictorial view of a collapsible bottle in accordance with a second embodiment of the present invention.
Figure 6:
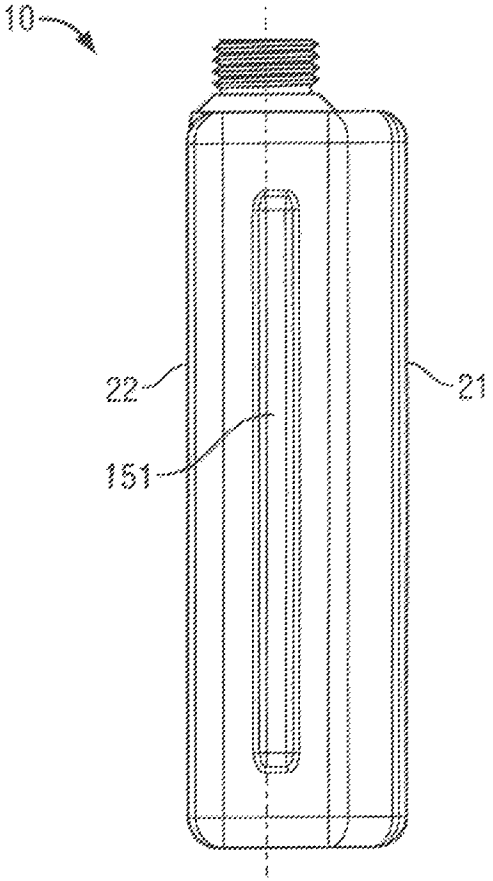
Figure 7:
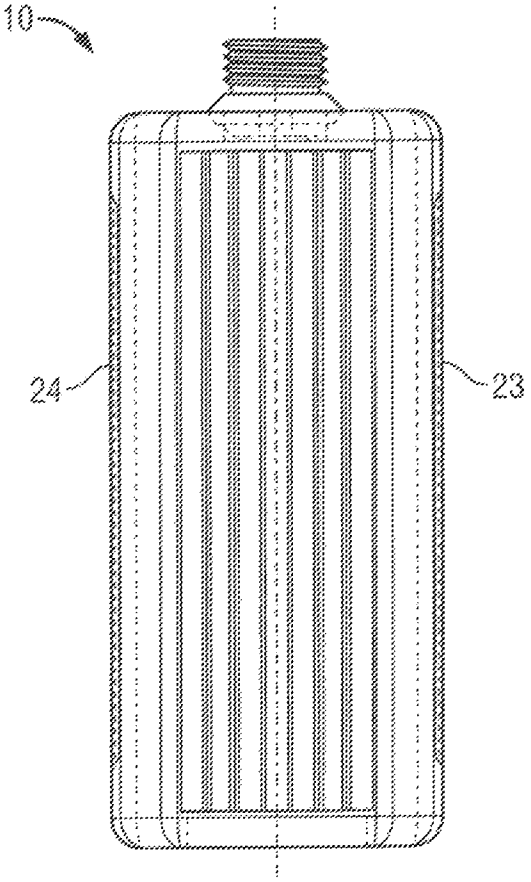
FIG. 7 is a front view of the bottle of FIG. 6.
Figure 9:
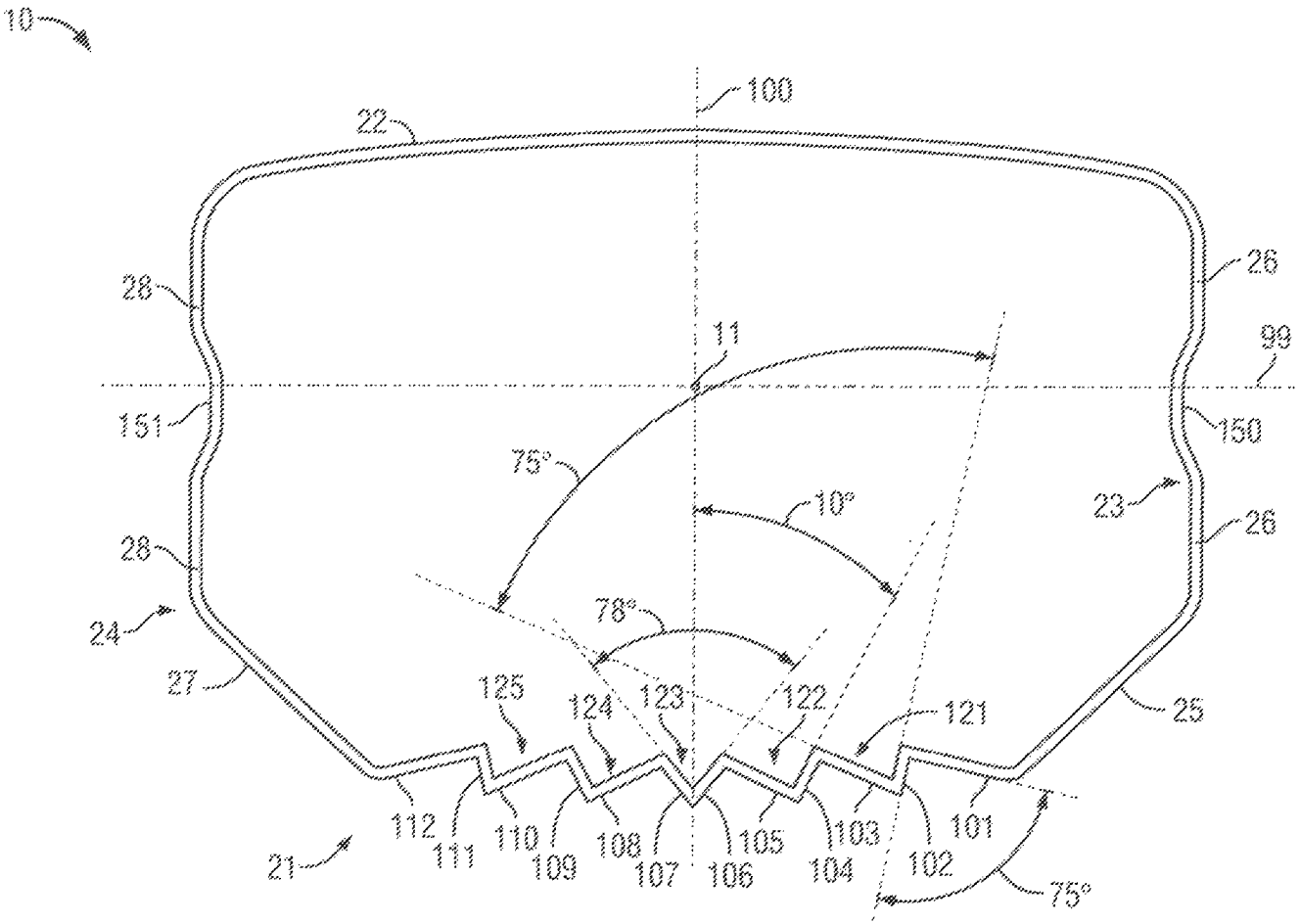
FIG. 9 is a cross-sectional view of the bottle of FIG. 6 along section line 9-9' in FIG. 7.

In the embodiment of FIG. 6, the front wall 21 is a rectangular panel between the right corner 36 and the left corner 37 symmetrical about a central plane 100 shown on FIG. 9 to be normal to the rear wall 22. The front wall 21 includes a series of longitudinal panels including a first panel 101, a second panel 102, a third panel 103, a fourth panel 104, a fifth panel 105, a sixth panel 106, a seventh panel 107, an eighth panel 108, a ninth panel 109, a tenth panel 110, an eleventh panel 111 and a twelfth panel 112. Each of the panels 101, 103 and 105 are disposed in flat planes parallel to each other forming an angle of 75 degrees with the center plane 100. Each of the panels 102, 104 and 106 are disposed in flat planes parallel to each other forming an angle of 65 degrees with the center plane 100. Each of the panels 112, 110 and 108 are disposed in flat planes parallel to each other forming an angle of 65 degrees with the center plane 100. Each of the panels 102 and 104 are disposed in flat planes parallel to each other forming an angle of 10 degrees with the center plane 100. Each of the panels 109 and 111 are disposed in flat planes parallel to each other forming an angle of 10 degrees with the center plane 100. Each of the panels 106 and 107 form an angle of 36 degrees with the center plane 100. Five channelways are defined between adjacent of the panels 101 to 112 as channelways 121, 122, 123, 124 and 125. Channelway 123 is a center channelway with an angle spanning about 78 degrees between the panels 106 and 107. Each of the other channelways 121, 122, 124 and 125 span a respective angle of about 75 degrees between the interior surface 38 over the adjacent panels by which each channelway is formed inwardly in the cavity.

Figure 10:
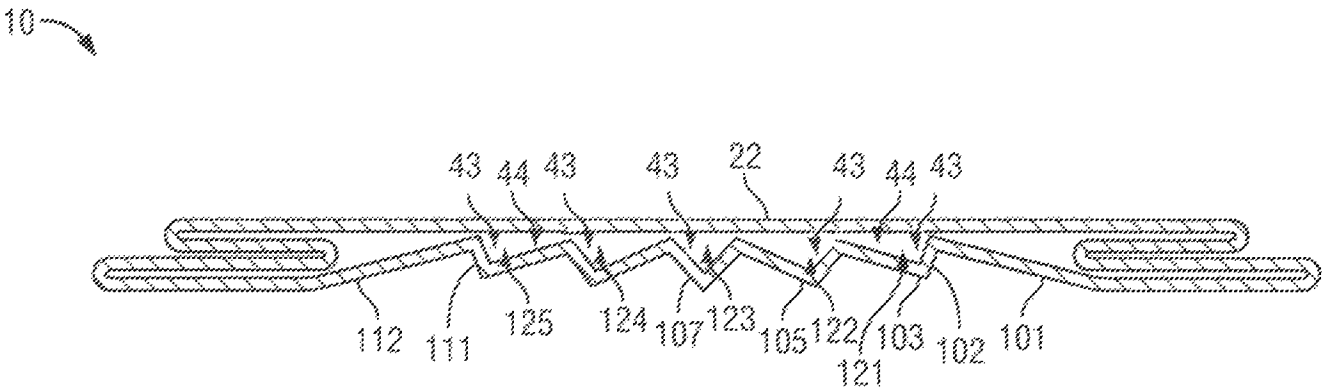
FIG. 10 is a cross-sectional view similar to FIG. 9 but showing the bottle in a fully collapsed condition.

The front wall 21 has a top header portion 130 and a bottom header portion 131, each disposed in a plane perpendicular to the center plane 100 and generally parallel to a plane in which each of the top wall 17 and the bottom wall 18 lies. Each of the panels 101 to 112 extends between the top header portion 130 and the bottom header portion 131 with each of the channelways 122 to 125 extending to the header portions and the engagement of the panels 101 to 112 with the header portions assisting in providing resistance of the channelways 122 to 125 to collapse under vacuum conditions in the bottle. As seen in FIG. 10 showing a collapsed condition of the bottle 10 of FIG. 6, the front wall 21 is drawn into engagement with the rear wall 22 with the rear wall 22 to bridge the respective flow channel 43 formed within each channelway and with a flow passageway 44 being defined between the front wall 21 and its channelways and the rear wall 22 extending longitudinally to provide for fluid flow through the flow passageway 44 even when the bottle 10 is in a fully collapsed condition as shown in FIG. 10.

The top header portion 130 extends inwardly with a number of triangular portions bridging between the panels 101 and 102; between the panels 103 and 104; between the panels 105 and 106; between the panels 107 and 108; between the panels 109 and 110 and between the panels 111 and 112. Preferably, each of these triangular portions are interconnected along a continuous edge portion which extends outwardly of the apexes as, for example, between the panels 101 and 102, 103 and 104, 105 and 106, 107 and 108, 109 and 110 and 111 and 112. These triangles and the joining edge portion along the apexes provides the top header portion 130 as a reinforcing member tending to provide transverse stability to the front wall across its width and together with the panels 101 to 112 forming the channelways to provide a relatively rigid three dimensional structure on the front wall 21 which resists deflection both longitudinally and transversely of the front wall 21. However, as is to be appreciated, each of the channelways as, for example, the center channelway 123 formed between the panels 106 and 107, extends longitudinally through the top header portion 130 and the bottom header portion 131 to provide for fluid passage through the channelway 123 from the closed end 12 to the open end 13 of the bottle.

In the second embodiment, the rear right portion 26 of the right wall 23 includes a fold slot 150 extending longitudinally therein and, similarly, the rear left portion 28 of the left wall 24 includes a left fold slot 151 extending longitudinally therein. These right and left fold slots 150 and 151 extend inwardly in the respective right and left walls 23 and 24 and provide longitudinally extending weakened portions of further reduced wall thickness about which each of the rear right portion 26 of the right wall and the rear left portion 28 most readily fold assisting the side wall 20 towards a controlled collapse of the right wall 23 inwardly upon itself and the left wall 24 inwardly upon itself and towards the rear wall 22 as the front wall 21 is drawn toward engagement with the rear wall 22.

The arrangement of a plurality of panels such as 101, 102, 103, 104, 105, 106, 107, 108, 109, 110, 111 and 112 with the top header portion 130 and a bottom header portion 131 such as shown in the second embodiment is useful in collapsible bottles to assist in maintaining the wall which contains these panels and header portions to have a dimensional stability which resists undo twisting or bending of the front wall either transversely or longitudinally. Thus, the structure of the channelway forming panels 101 to 112 and the top and bottom header portions 130 and 131 may be provided in both the front wall 21 and the rear wall 22 of bottles, particularly in bottles which may be formed with relatively thin walls such as, for example, a bottle of the type shown in U.S. Design Pat. No. D350,070 to Ophardt, issued Aug. 30, 1994, the disclosure of which is incorporated herein by reference. Such a bottle has a close to square configuration and the right wall and left wall are provided with a structure to assist in inward collapse of the right wall and the left wall. In a bottle similar to that as shown in Ophardt D350,070, which may be square, the folding of the right wall and the left wall upon themselves may substantially prevent the front wall and the rear wall from coming into engagement with each other nevertheless the front wall and the rear wall will come to collapse upon the folded portions of the side walls and the channelways provided in the front wall will assist in ensuring that there is a flow channel and flow passageway 44 formed longitudinally within the channels during all conditions of collapse of the bottle.

Figure 11:
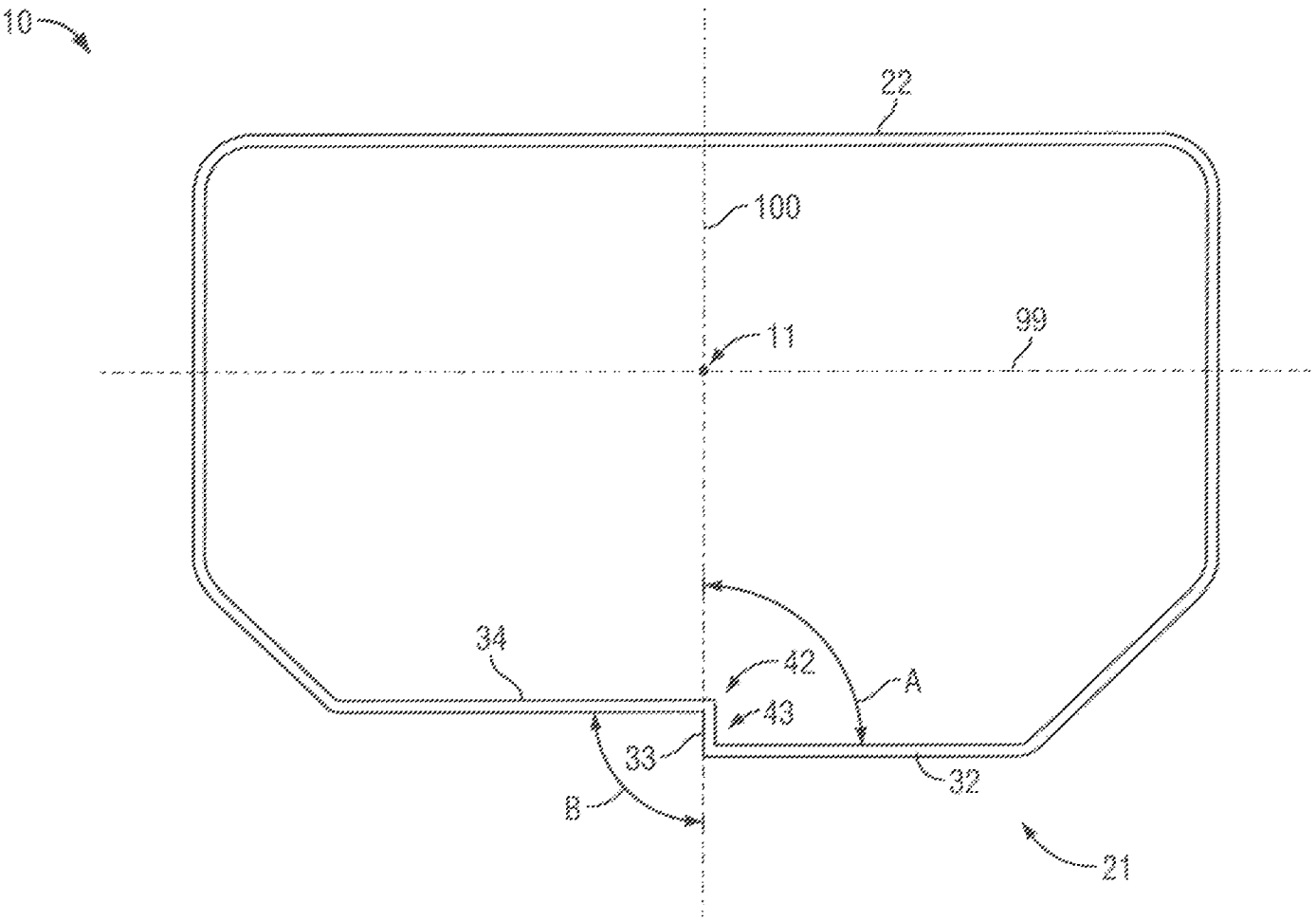
FIG. 11 illustrates a top cross-sectional view similar to FIG. 4 but showing a third embodiment of a collapsible bottle in accordance with the present invention in an uncollapsed position.

Reference is made to FIG. 11 which illustrates a third embodiment of a collapsible bottle 10 in accordance with the present invention having substantial similarities to the first embodiment illustrated in FIG. 1, however, in FIG. 11, the left face portion 34 is disposed to be parallel to the right face portion 32 but at a different distance from the rear wall 22. In FIG. 11, the angle A is 90 degrees and the angle B is also 90 degrees, however, angle A may be preferably in the range of 75 degrees to 120 degrees and the angle B may be preferably in the range of 75 degrees to 120 degrees.

Figure 12:
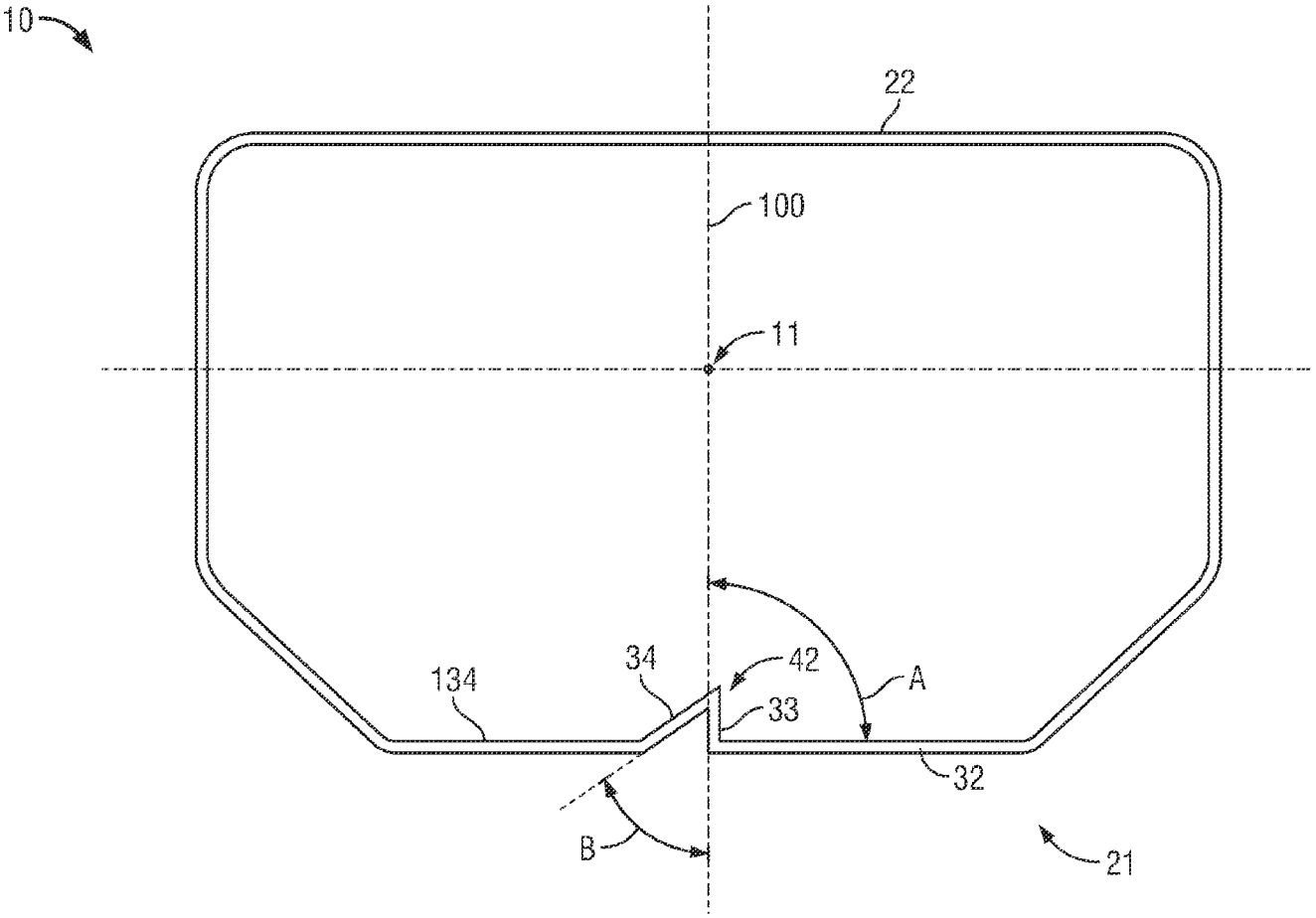
FIG. 12 illustrates a top cross-sectional view similar to FIG. 4 but showing a fourth embodiment of a collapsible bottle in accordance with the present invention in an uncollapsed position.

Reference is made to FIG. 12 which illustrates a fourth embodiment of a collapsible bottle 10 having similarities to the first embodiment, however, in which the front wall 21 comprises not only a right face portion 32, a step portion 33 and a left face portion 34 but also a leftmost portion 134. The leftmost portion 134 and the right face portion 32 are shown to be disposed in the same flat plane parallel to the rear wall 22. The angle A is 90 degrees but may be preferably in the range of 60 degrees to 120 degrees and the angle B is 64 degrees but may preferably in the range of 75 degrees to 90 degrees.

In the first embodiment of FIG. 1 and the third embodiment of FIG. 11, the one channelway 42 is effectively formed by a step in the front wall 21 formed by three panels in the front wall 21; in the fourth embodiment of FIG. 12, a channelway is formed with the front wall 21 having four panels.

Figure 13:
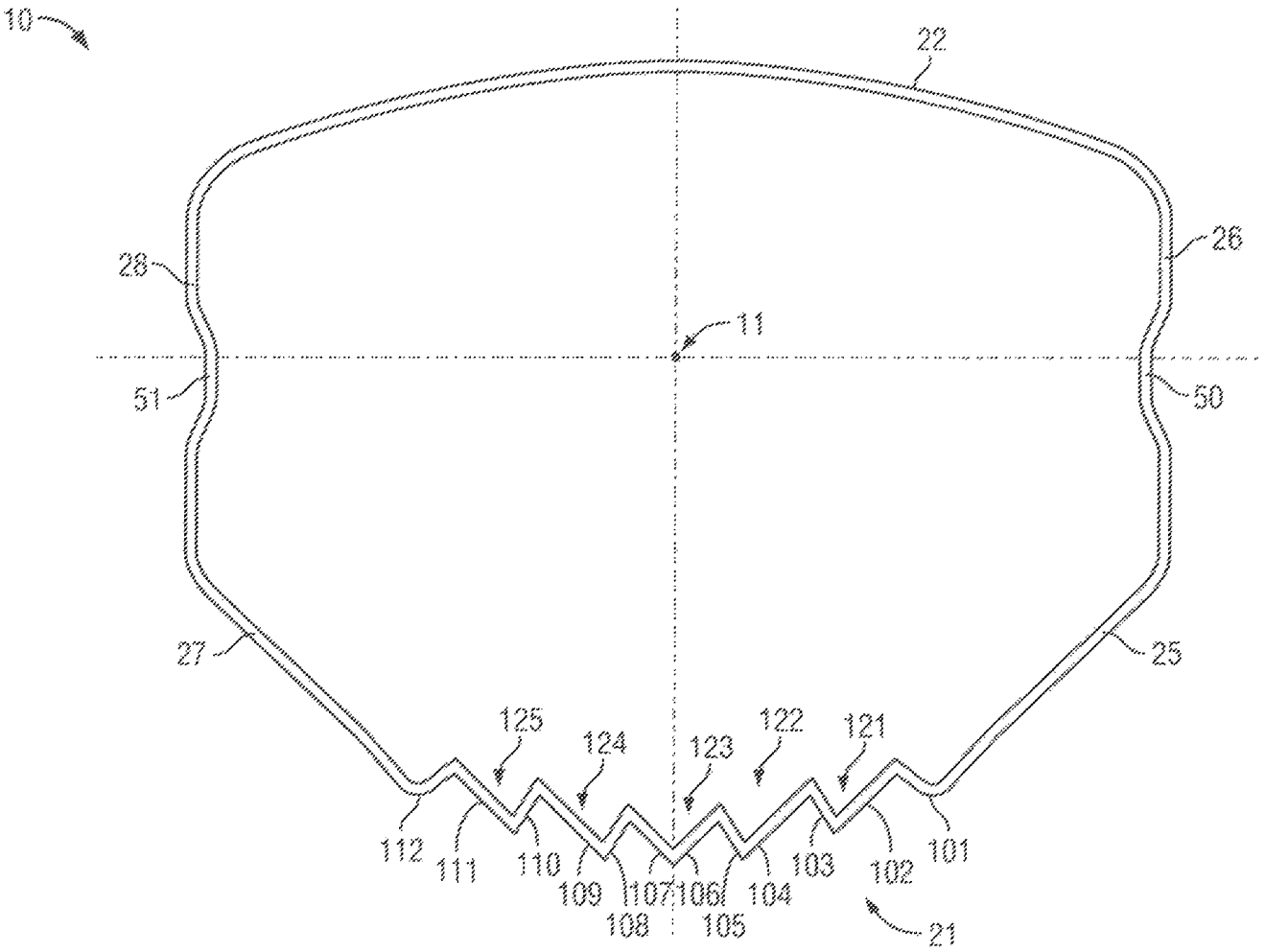
FIG. 13 illustrates a top cross-sectional view similar to FIG. 9 but showing a fifth embodiment of a collapsible bottle in accordance with the present invention in an uncollapsed position.

Reference is made to FIG. 13 which illustrates a fifth embodiment of a collapsible bottle 10 in accordance with the present invention having substantial similarities to the second embodiment, however, in which the rear wall 22 and the front wall are shown as being curved, that is, convex bowing outwardly. The channelways 121 to 125 are provided in the front wall 21, however, at least two of the panels 101 and 112 are shown as being arcuate rather than lying in a flat plane, and other of the panels 102 to 111 may be arcuate.

The preferred first, third and fourth embodiments illustrate arrangements with a single channelway 42 and the second and fifth embodiments illustrate embodiments with a plurality of channelways. Each of the embodiments illustrates one or more such channelways merely in the front wall 21. However, the channelways could alternatively be provided exclusively in the rear wall 22 or in both the front wall 21 and the rear wall 22.

The preferred first to fourth embodiments illustrate the different panels of the front wall 21 forming a channelway as being disposed in flat planar planes, however, as seen in the fifth embodiment, this is not necessary and each of the panels of the front wall 21 forming a channelway may be arcuate or curved. The resultant structure forming a channelway needs to have sufficient resistance to collapse that a flow channel through the channelway will provide and maintain for longitudinal fluid flow and form a flow passage between the channelway and the rear wall 22 for fluid flow therethrough under threshold vacuum conditions to be applied to fully collapse the bottle.

The particular cross-sectional shape of a bottle useful with the present invention is not limited. The bottle may be rounded or rectangular or square. Insofar as two opposed surfaces of the side wall of the bottle are drawn together, characterized as interior surfaces of a front wall and a rear wall, the provision of the channelway assists in ensuring that there may be a longitudinal flow channel for fluid to pass through and out the outlet of the bottle under appropriate vacuum conditions to collapse the bottle and all conditions that the bottle assumes between a full or un-collapsed condition and a fully collapsed condition including all partially collapsed conditions in between.

While advantageous, it is not necessary that the central axis 11 be displaced towards the rear wall and the central axis may be displaced towards the front wall or equidistance between the rear wall and the front wall. For example, in the embodiment of FIG. 12, the center axis may be moved from the location where it is shown on FIG. 12 forwardly towards the front wall 21 such that the center axis is equidistance between the front wall 21 and the rear wall 22.

The preferred embodiments illustrate a generally rectangular bottle in which the front wall and rear wall are spaced a lesser distance than the right wall and left wall are spaced. While this is preferred, it is not necessary.

The preferred embodiments illustrate a bottle 10 adapted to collapse with the right wall and left wall drawn inwardly to fold about themselves. This is preferred, but not necessary. The bottle may have the right wall and the left wall adapted during collapse to extend outwardly and fold about themselves increasing the overall width of the bottle as seen looking at the front wall. For example, the bottle may have a configuration similar to that of the bottle of U.S. Pat. No. 5,080,260 to During, issued Jun. 14, 1992, the disclosure of which is incorporated herein by reference, with each of the right wall and the left wall to be extended outwardly at their center as seen in top view and in collapse to become folded about themselves and extend outwardly, however, in accordance with the present invention, with at least one of the front wall and the rear wall to have at least one channelway of the type disclosed in the embodiments of this invention extend longitudinally such that in collapse with engagement of the front wall and the rear wall a longitudinal flow channel and flow passageway are maintained at all times during collapse of the bottle as the front wall and the rear wall are drawn into engagement. It is to be appreciated that the bottle of During increases in overall width as it collapses and, therefore, is often not useful to be placed inside a closed housing as in a soap dispenser in which it may not be disadvantageous for the housing to have increased dimensions merely to accommodate a bottle as it increases in a dimension while collapsing.

Each embodiment of a collapsible bottle 10 is in accordance with the present invention is preferably formed of plastic or other materials with the walls of the bottle being sufficiently thin as to be deformable as under vacuum conditions in the bottle. The collapsible bottles are preferably formed by blow-moulding processes.

The collapsible bottles in accordance with the present invention is adapted for containing and dispensing fluids such as hand cleaning fluids but not limited to hand cleaning fluids. The fluids to be dispensed can include preferably fluids with high viscosity and fluids which contain solid materials such as particulate matter, for example, pumice to be used as grit in abrasive cleaning fluid. The particular nature of the fluid to be dispensed is not limited and may be any manner of product including, for example, flowable creams, food products such as ketchup and sauces, medicinal fluids, paints, pastes, adhesives, grease and lubricating materials.

While the invention has been described with reference to the preferred embodiments, many modifications and variations will now occur to a person skilled in the art. For a definition of the invention, reference is made to the following claims.

I claim:

1. A collapsible bottle having a first end and a second end;

the bottle having an enclosed cavity defined between the first end and the second end and an encircling side wall bridging between the first end and the second end, the side wall including a front wall and a rear wall opposed to the front wall, a discharge outlet at the first end, wherein the bottle is collapsible such that when vacuum conditions are applied to the outlet, the bottle collapses with the front wall and the rear wall drawn towards each other and into engagement with each other, the front wall carrying a channelway, the channelway defining a flow channel which is open toward the rear wall between the first end and the second end, wherein during collapse of the bottle when the front wall and the rear wall are drawn into engagement, the rear wall engages the front wall to bridge the flow channel and a flow passageway is defined between the channelway of the front wall and the rear wall permitting fluid flow therethrough between the first end and the second end.

2. A collapsible bottle as claimed in claim 1 wherein:

the bottle contains a fluid which is drawn from the outlet when the vacuum conditions are applied to the outlet, and the vacuum conditions include a threshold vacuum condition required to draw a substantial portion of the fluid from the outlet, the channelway maintains the flow channel provided the vacuum conditions do not exceed the threshold vacuum condition.

3. A collapsible bottle as claimed in claim 2 wherein:

the channelway having a rigidity which resists deflection when the vacuum conditions exist in the cavity.

4. A collapsible bottle as claimed in claim 2 wherein:

the channelway having a rigidity which resists deflection sufficiently that the flow channel is maintained when the vacuum conditions exist in the cavity not greater than the threshold vacuum condition.

5. A collapsible bottle as claimed in claim 4 wherein the flow channel extends between the first end and the second end.

6. A collapsible bottle as claimed in claim 5 wherein the flow passageway extends between the first end and the second end.

7. A collapsible bottle as claimed in claim 4 wherein:

the channelway is one channelway of a plurality of parallel channelways with each channelway formed between adjacent parallel panels in an array of the parallel panels folded in an accordion-like array.

8. A collapsible bottle as claimed in claim 4 wherein:

the front wall includes a first end header portion proximate the first end and a second end header portion spaced from the first end header towards the second end, the channelway and its flow channel ending proximate the first end at a first end formed by the first header portion, the channelway and its flow channel ending proximate the second end at a second end formed by the second header portion.

9. A collapsible bottle as claimed in claim 8 wherein each of the first header portion and the second header portion extends towards the rear wall.

10. A collapsible bottle as claimed in claim 9 wherein the side wall comprises a thin sheet member circumferentially about the cavity.

11. A collapsible bottle as claimed in claim 4 wherein:

the side wall has an interior surface and an exterior surface;

the channelway comprises a first portion of the front wall extending from the first end toward the second end and a second portion of the front wall extending from the first end toward the second end adjacent the first portion, the interior surface over the first portion opening into the cavity, the interior surface over the second portion open into the cavity opposed to the interior surface over the first portion, the channelway defined between the interior surface over the first portion and the interior surface over the second portion.

12. A collapsible bottle as claimed in claim 11 wherein:

the first portion is disposed in a first flat plane, the second portion is disposed in a second flat plane, the first portion and the second portion join along a common first longitudinal edge with the first flat plane forming an angle of not greater than 120 degrees with the second flat plane.

13. A collapsible bottle as claimed in claim 12 wherein:

the front wall has a third portion extending from the first end toward the second end adjacent the second portion, the third portion is disposed in a third flat plane, the second portion and the third portion join along a common second longitudinal edge with the second flat plane forming an angle of not greater than 120 degrees with the third flat plane.

14. A collapsible bottle as claimed in claim 13 wherein:

the front wall has a fourth portion extending from the first end toward the second end adjacent the third portion, the fourth portion is disposed in a fourth flat plane, the third portion and the fourth portion join along a common third longitudinal edge with the third flat plane forming an angle of not greater than 120 degrees with the fourth flat plane.

15. A collapsible bottle as claimed in claim 1 wherein the side wall includes a right wall and a left wall, the rear wall and the front wall are spaced a distance less than distance the right wall and the left wall are spaced, during collapse of the bottle, a center portion of the right wall being drawn inwardly with the right wall to become folded upon itself and a center portion of the left wall is drawn inwardly with the left wall to become folded upon itself, in a fully collapsed condition, the center portion of the right wall and the center portion of the left wall are spaced from each other and the rear wall and the front wall are drawn into engagement therebetween, the channelways being provided in the front wall to extend longitudinally of the front wall where the front wall engages with the rear wall between the center portions.

16. A collapsible bottle as claimed in claim 15 wherein the discharge opening is disposed about a central axis, the side wall extending parallel to the central axis, the discharge opening located closer to the rear wall than the front wall and equidistance between the right wall and the left wall, and wherein the bottle is manufactured from plastic by a manufacturing process including blow moulding.

17. A collapsible bottle as claimed in claim 16 wherein each of the right wall and the left wall include fold slots which induce, during collapse of the bottle under vacuum conditions, each of the right wall and the left wall to be drawn inwardly to fold about themselves.

18. A collapsible bottle as claimed in claim 1 wherein:

the side wall has an interior surface and an exterior surface;

the channelway comprises a first portion of the front wall extending from the first end toward the second end and a second portion of the front wall extending from the first end toward the second end adjacent first portion, the interior surface over the first portion opening into the cavity, the interior surface over the second portion open into the cavity opposed to the interior surface over the first portion, the channelway defined between the interior surface over the first portion and the interior surface over the second portion, the first portion is disposed in a first plane, the second portion is disposed in a second plane, the first portion and the second portion join along a common first longitudinal edge with the first plane forming angle of not greater than 120 degrees with the second plane.

19. A collapsible bottle as claimed in claim 18 wherein the first plane is a first flat plane and the second plane is a second flat plane.

20. A collapsible bottle as claimed in claim 18 wherein the angle is in the range of 75 degrees to 90 degrees.

* * * * *